US009637330B2

(12) United States Patent
Yamamoto

(10) Patent No.: US 9,637,330 B2
(45) Date of Patent: May 2, 2017

(54) IMAGE FORMING APPARATUS

(71) Applicant: Brother Kogyo Kabushiki Kaisha, Nagoya-shi, Aichi-ken (JP)

(72) Inventor: Koyo Yamamoto, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/047,691

(22) Filed: Feb. 19, 2016

(65) Prior Publication Data

US 2016/0244285 A1 Aug. 25, 2016

(30) Foreign Application Priority Data

Feb. 19, 2015 (JP) ..... 2015-030319

(51) Int. Cl.
*B65H 3/06* (2006.01)
*B65H 1/04* (2006.01)

(52) U.S. Cl.
CPC ..... *B65H 1/04* (2013.01); *B65H 2402/441* (2013.01); *B65H 2402/46* (2013.01); *B65H 2405/11164* (2013.01); *B65H 2405/324* (2013.01); *B65H 2405/3322* (2013.01); *B65H 2407/21* (2013.01); *B65H 2511/11* (2013.01); *B65H 2511/20* (2013.01)

(58) Field of Classification Search
CPC .... B65H 2405/324; B65H 2405/11164; B65H 2402/441
See application file for complete search history.

(56) References Cited

U.S. PATENT DOCUMENTS 7,547,015 B2 * 6/2009 Lee ..... B65H 31/02 271/207
2003/0227127 A1 * 12/2003 Chang ..... B65H 1/04 271/171
2011/0241286 A1 * 10/2011 Ishii ..... B65H 1/266 271/167

FOREIGN PATENT DOCUMENTS

JP 2006-124147 A 5/2006
JP 2007-197098 A 8/2007
JP 2009-155006 A 7/2009
JP 2015-143148 A 8/2015

* cited by examiner

*Primary Examiner* — Howard Sanders
(74) *Attorney, Agent, or Firm* — Banner & Witcoff, Ltd.

(57) ABSTRACT

An image forming apparatus includes a casing having an opening, a supporting portion configured to support a sheet inserted through the opening, a feed roller configured to feed the sheet supported on the supporting portion, and a first regulation member configured to move between an upright position and a flat position where the first regulation member is laid relative to the upright position. The first regulation member includes a first surface facing the feed roller when the first regulation member is at the upright position, and a second surface facing upward when the first regulation member is at the upright position, the second surface facing the feed roller when the first regulation member is at the flat position such that the second surface regulates a position of an upstream end, in a sheet conveying direction, of the sheet supported on the supporting portion of the casing.

14 Claims, 9 Drawing Sheets

IMAGE FORMING APPARATUS

CROSS-REFERENCE TO RELATED APPLICATION

This application claims priority from Japanese Patent Application No. 2015-030319 filed on Feb. 19, 2015, the content of which is incorporated herein by reference in its entirety.

FIELD OF DISCLOSURE

The disclosure relates to an image forming apparatus including a supporting portion configured to support one or more sheets thereon.

BACKGROUND

A known image forming apparatus includes a supporting portion configured to support a sheet inserted from an opening formed in a casing, and a cover configured to open and close the opening, and to support, with the opening open, a portion of the sheet on the supporting portion when the portion is disposed outside the casing. The cover includes a regulation guide configured to regulate a position of an upstream end of a sheet in a sheet conveying direction. The regulation guide is configured to slidably move in the sheet conveying direction relative to the cover, and to be removably attached to the cover. Accordingly, the regulation guide may be removed from the cover and reversed to regulate positions of upstream ends of sheets of different sizes.

SUMMARY

However, when a sheet of a different size is used, the regulation guide needs to be removed, which is troublesome.

One or more aspects of the disclosure are to provide an image forming apparatus that increases the convenience of users when sizes of sheets are changed.

According to an aspect of the disclosure, an image forming apparatus includes a casing having an opening, a supporting portion configured to support a sheet inserted through the opening, a feed roller configured to feed the sheet supported on the supporting portion, and a first regulation member configured to move between an upright position and a flat position where the first regulation member is laid relative to the upright position. The first regulation member includes a first surface facing the feed roller when the first regulation member is at the upright position, and a second surface intersecting with the first surface. The second surface faces upward when the first regulation member is at the upright position. The second surface faces the feed roller when the first regulation member is at the flat position such that the second surface regulates a position of an upstream end, in a sheet conveying direction, of the sheet supported on the supporting portion of the casing.

With this configuration, by moving the first regulation member from the upright position to the flat position, the second surface may regulate a position of the upstream end, in the conveying direction, of the sheet P whose size is smaller than a size of a sheet P that may be regulated by the first surface. Accordingly, convenience for users may be improved when sizes of sheets P are changed.

DETAILED DESCRIPTION

An illustrative embodiment of the disclosure will be described in detail with reference to the accompanying drawings. In the following description, first, general structures of an image forming apparatus, e.g., a laser printer 1, will be described, and then features of the disclosure will be described in detail.

Figure 1:
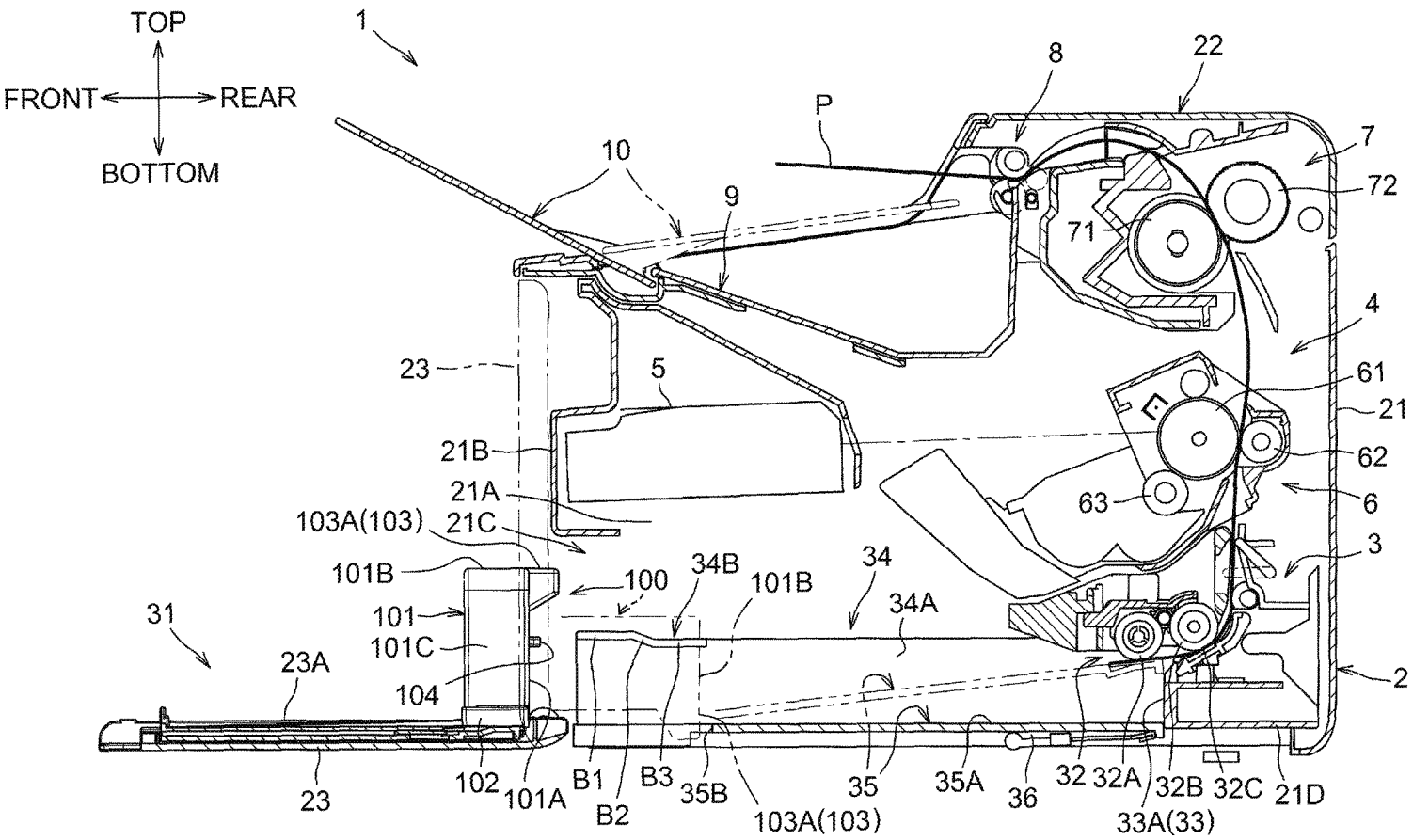
FIG. 1 depicts general structures of a laser printer in an illustrative embodiment according to one or more aspects of the disclosure.

Hereinafter, description will be made with reference to directions that are defined in conjunction with an orientation in which a user uses the laser printer 1. For example, left and right sides in FIG. 1 are defined as front and rear sides of the laser printer 1, respectively. Front and back sides of the sheet of FIG. 1 are defined as right and left sides of the laser printer 1, respectively. Upper and lower sides in FIG. 1 are defined as top/upper and bottom/lower sides of the laser printer 1, respectively.

As depicted in FIG. 1, the laser printer 1 includes a main unit 2, a sheet feeder 3 configured to feed a sheet, e.g., a paper sheet P, an image forming unit 4 configured to form an image on the sheet P. The main unit 2 includes a casing 21, a top cover 22, and a front cover 23 as an example of a cover. In the disclosure, the meaning of "a sheet P" and "the sheet P" includes plural reference.

Figure 2:
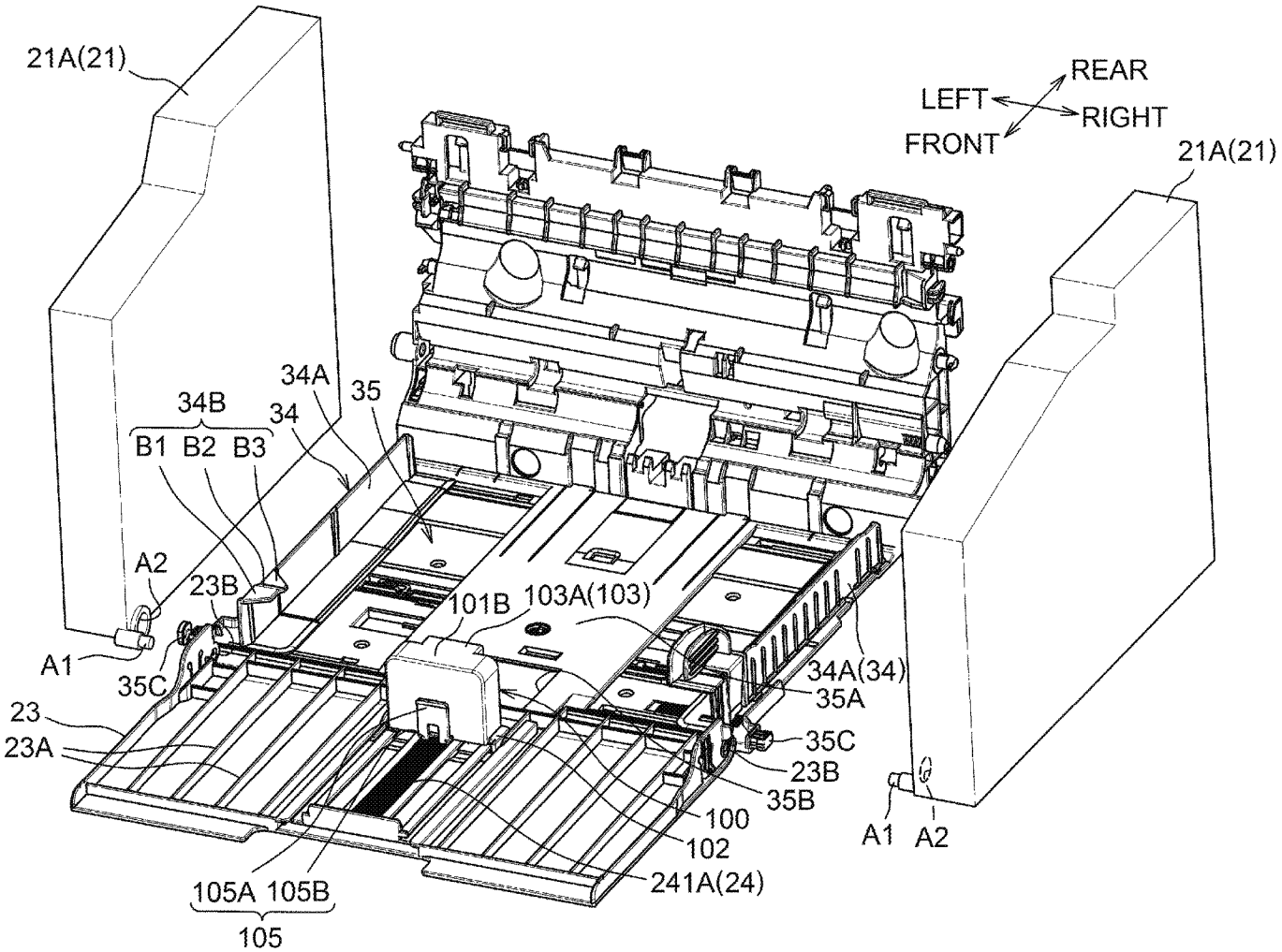
FIG. 2 is an exploded perspective view of a front cover, side frames and a feeder.

The casing 21 includes a pair of side frames 21A facing each other in the left-right direction, and a front wall 21B constituting a front surface of the casing 21. The side frames 21A sandwiches the image forming unit 4 and a lifter plate 35 (described below) therebetween in the left-right direction. As depicted in FIG. 2, each side frame 21A includes a support shaft A1 protruding inward in the left-right direction from a lower front corner portion thereof. Each side frame 21A has a hole A2 formed behind a corresponding support shaft A1.

As depicted in FIG. 1, the front wall 21B connects front ends of the side frames 21A. A lower end of the front wall 21B is disposed above lower end portions of the side frames 21A. With this structure, an opening, e.g., an insertion opening 21C, into which a sheet P is inserted, is defined at a lower portion of a side surface, e.g., a front surface (e.g., a front-side surface defined by, for example, the side frames 21A and the front wall 21B) of the casing 21.

The top cover 22 is pivotally supported by the casing 21 about a rotation shaft disposed at a rear end portion thereof. An upper surface of the top cover 22 functions as a discharge tray 9 configured to receive a sheet P discharged by discharge rollers 8 (described below) outside the casing 21. An extension cover 10 is provided to the discharge tray 9. The extension cover 10 is configured to move, in response to pivoting relative to the top cover 22, between a position, as depicted by a two-dot chain line, where the extension cover 10 covers an upper surface of the discharge tray 9, and another position, as depicted by a solid line, where the extension cover 10 is unfolded to expose the upper surface of the discharge tray 9 and support a front end portion of a sheet P on the discharge tray 9.

The front cover 23 is configured to cover the front surface of the casing 21. A lower end portion of the front cover 23 is pivotally supported by the casing 21. In one example, as depicted in FIG. 2, the front cover 23 has holes 23B formed at positions corresponding to the respective support shafts A1. The front cover 23 is pivotally supported by a front portion of the casing 21 as each of the support shafts A1 engages with a corresponding one of the holes 23B. With this structure, as depicted in FIG. 1, the insertion opening 21C of the casing 21 may be open or closed as the front cover 23 pivots in the front-rear direction.

The sheet feeder 3 is located at a lower portion of the casing 21. The sheet feeder 3 mainly includes a supporting portion 31 configured to support a sheet P inserted from the insertion opening 21C, an end regulating portion 33 configured to regulate a position of a leading end of the sheet P (e.g., a downstream end of the sheet P in a conveying direction), a pair of side guides 34, as an example of a second regulation member, configured to regulate positions of side ends of the sheet P on the supporting portion 31, and a feeding mechanism 32 configured to feed the sheet P on the supporting portion 31 toward the image forming unit 4.

As depicted in FIGS. 1 and 2, the supporting portion 31 includes the front cover 23 and the lifter plate 35, as an example of a first supporting portion, which constitutes a bottom surface of the casing 21. For example, the supporting portion 31 extends from inside to outside the casing 21 beyond the insertion opening 21C.

The lifter plate 35 constitutes a portion of the supporting portion 31 inside the casing 21. The front cover 23, when pivoting to the front to open the insertion opening 21C, constitutes a portion of the supporting portion 31 outside the casing 21. The front cover 23 includes a regulation guide 100, as an example of a first regulation member, configured to regulate a position of a trailing end of the sheet P (e.g., an upstream end of the sheet P in the conveying direction).

The lifter plate 35 extends from a front end of the casing 21 to a location proximate to a rear end of the casing 21. A central portion of the lifter plate 35 in the left-right direction protrudes upward. An upper surface of the central portion is a supporting surface 35A configured to support a sheet P. A front end portion of the supporting surface 35A has a rectangular-shaped cutout 35B as an example of an accommodating portion. As depicted in FIG. 2, the lifter plate 35 includes rotation shafts 35C disposed at front end portions thereof and protruding outward in the left-right direction. The rotation shafts 35C are located at positions where each of the rotation shafts 35C faces the hole A2 of a corresponding one of the side frames 21A. Each rotation shaft 35C is engageable with a corresponding hole A2. Thus, the lifter plate 35 is pivotally supported by the side frames 21A.

As depicted in FIG. 1, the lifter plate 35 is configured to move closer to and away from a pickup roller 32A (described below). As a lifter member 36 disposed below the lifter plate 35 is pivotally moved by a known mechanism and a control device that are not depicted, a rear end portion of the lifter plate 35 may be raised. Accordingly, the lifter plate 35 may move closer to the pickup roller 32A. For example, when no print instruction is provided, the lifter plate 35 is in a standby state in which the lifter plate 35 is most distant from the pickup roller 32A and generally horizontal. When a print instruction is provided, the lifter plate 35 pivots upward, as depicted in a two-dot chain line in FIG. 1, to approach the pickup roller 32A.

The end regulating portion 33 is disposed behind the lifter plate 35 and extends upward from a bottom wall 21D of the casing 21. The end regulating portion 33 includes a front surface 33A at which a position of a leading end of a sheet P (e.g., a downstream end of the sheet P in the conveying direction) may be regulated.

As depicted in FIGS. 1 and 2, the side guides 34 are supported by the lifter plate 35 to slidably move in the left-right direction. Each side guide 34 includes a side wall 34A extending upward from the lifter plate 35, and an extension wall 34B, as an example of an overload preventing portion, protruding inward in the left-right direction from an upper end of the side wall 34A. The side wall 34A is configured to regulate a position of a side end of a sheet P, and extends from a front end to a rear end of the lifter plate 35.

The extension wall 34B extends rearward from a front end of the side wall 34A. The extension wall 34B includes a front portion B1, a rear portion B3 positioned lower than the front portion B1, and an inclined portion B2 connecting the front portion B1 and the rear portion B3. The extension wall 34B may prevent the supporting surface 35A of the lifter plate 35 from being overloaded with sheets P. For example, a position of a lower surface of the rear portion B3 of the extension wall 34B corresponds to a full stack position or a maximum stack height to which sheets P may be maximally stacked on the supporting portion 31.

The inclined portion B2 extends downward and rearward from a rear end of the front portion B1 to a front end of the rear portion B3. With the inclined portion B2, a stack of sheets P may be readily inserted onto the supporting portion 31.

As depicted in FIG. 1, the feeding mechanism 32 mainly includes the pickup roller 32A as an example of a feed roller, a separation roller 32B, and a separation pad 32C. The pickup roller 32A is disposed above the rear end of the lifter plate 35. The separation roller 32B faces the separation pad 32C at a position downstream of the pickup roller 32A in the conveying direction of a sheet P.

In the sheet feeder 3, the front cover 23 is pivoted toward the front to provide the supporting portion 31. Thereafter, a stack of sheets P is inserted from the insertion opening 21C onto the supporting portion 31. When a print instruction is provided, the rear end portion of the lifter plate 35 is raised, so that an uppermost sheet P of the stack of sheets P on the supporting portion 31 contacts the pickup roller 32A. In this state, as the pickup roller 32A rotates, upper sheets P on the supporting portion 31 are fed to the separation roller 32B. The fed sheets P are separated one by one between the separation roller 32B and the separation pad 32C and supplied to the image forming unit 4.

The image forming unit 4 mainly includes a scanner unit 5, a process cartridge 6, and a fixing device 7.

The scanner unit 5 is disposed in a front portion of the casing 21 above the sheet feeder 3. The scanner unit 5 includes a laser emitting portion, a polygon mirror, and a lens that are not depicted. The scanner unit 5 is configured to scan across a surface of a photosensitive drum 61 (described below) at high speed by irradiating the surface of the photosensitive drum 61 with laser beam.

The process cartridge 6 is disposed in a rear portion of the casing 21 above the sheet feeder 3. The process cartridge 6 is configured to be removably attached to the casing 21, through an opening, which is provided at an upper portion of the casing 21 and is opened as the top cover 22 is open. The process cartridge 6 includes the photosensitive drum 61, a transfer roller 62 facing the photosensitive drum 61, a charger (reference numeral not designated), a developer roller 63, and a toner chamber (not depicted).

In the process cartridge 6, the surface of the photosensitive drum 61 that is rotating is uniformly charged by the charger. Thereafter, the surface of the photosensitive drum 61 is exposed to the laser beam from the scanner unit 5, to scan the surface of the photosensitive drum 61 at high speed. Accordingly, the potential level of the exposed portion lowers, and an electrostatic latent image based on image data is formed on the surface of the photosensitive drum 61.

Then, the toner in the toner chamber is supplied to the electrostatic latent image formed on the surface of the photosensitive drum 61 by the developer roller 63. Accordingly, a toner image is formed on the surface of the photosensitive drum 61. Thereafter, the sheet P is conveyed between the photosensitive drum 61 and the transfer roller 62, and the toner image carried on the surface of the photosensitive drum 61 is transferred on the sheet P.

The fixing device 7 is disposed at a rear portion of the casing 21 above the process cartridge 6. The fixing device 7 mainly includes a heat roller 71 and a pressure roller 72.

The heat roller 71 is configured to apply heat to a sheet P. The heat roller 71 includes thereinside a heat source, e.g., a halogen lamp. The pressure roller 72 is configured to convey the sheet P while holding the sheet P with the heat roller 71. The pressure roller 72 is disposed diagonally above and to the rear of the heat roller 71.

In the fixing device 7 as structured above, the toner transferred on the sheet P is thermally fixed on the sheet P while the sheet P is passing between the heat roller 71 and the pressure roller 72. The sheet P thermally fixed by the fixing device 7 is conveyed by the discharge rollers 8 disposed downstream of the fixing device 7 in the conveying direction and discharged onto the discharge tray 9 through the discharge rollers 8.

Next, structures of the supporting portion 31 will be described in detail. In the following description, unless otherwise specified, the supporting portion 31 will be described in conjunction with an orientation in which the front cover 23 is open.

Figure 3:
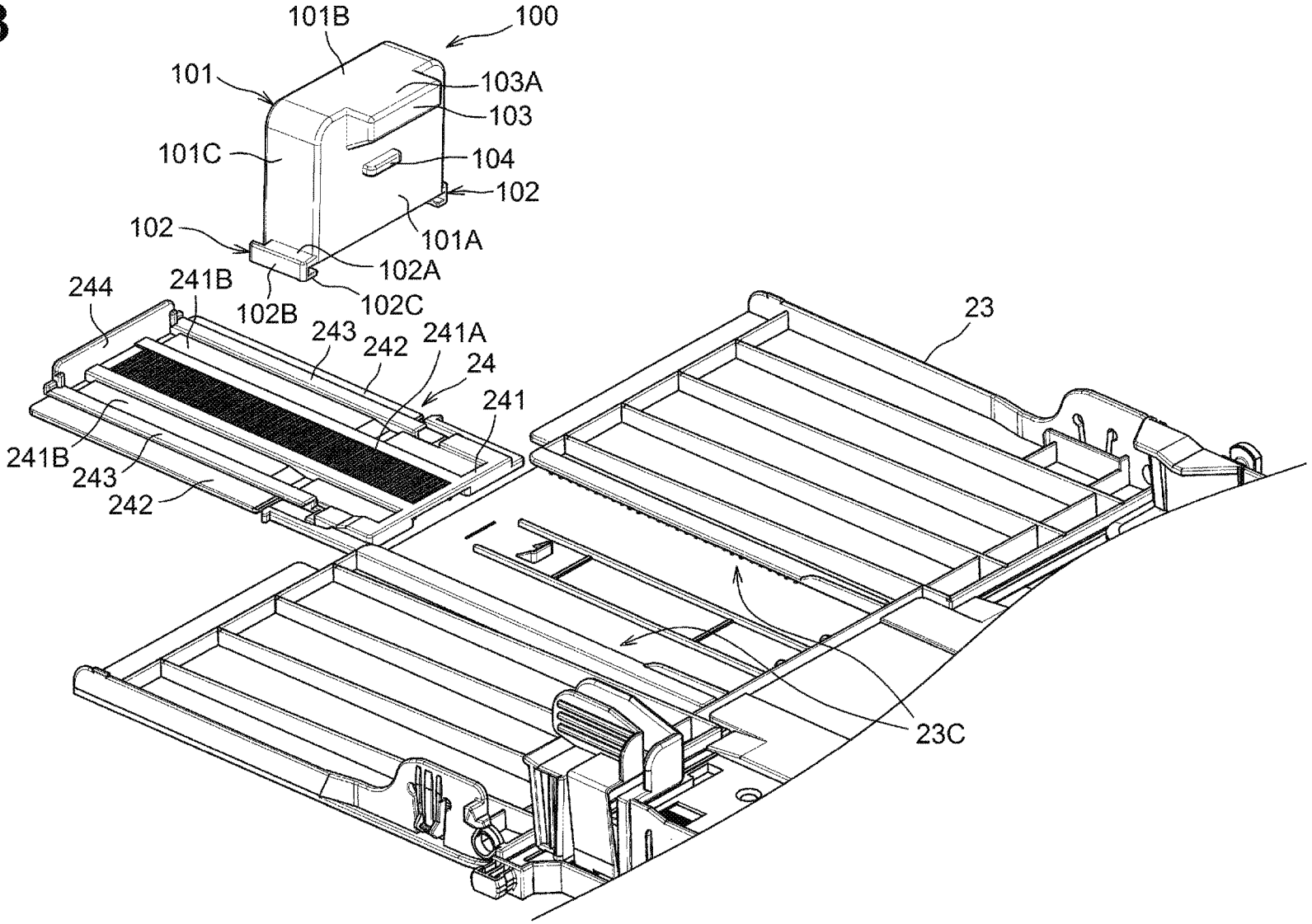
FIG. 3 is an exploded perspective view of a regulation guide, a support member and the front cover.

The front cover 23 constituting a portion of the supporting portion 31 further includes a support member 24, in addition to the regulation guide 100. As depicted in FIG. 3, the support member 24 is a plate-like member elongated in the front-rear direction and disposed at a central portion of the front cover 23 in the left-right direction. The support member 24 is configured to slidably move in the front-rear direction relative to the front cover 23.

The front cover 23 has an inner surface that is an upper surface 23A when the front cover 23 is open. The front cover 23 includes grooved portions 23C, each disposed on the inner surface thereof at a respective one of left and right sides of the support member 24. The grooved portions 23C are configured to guide sliding movement of the support member 24. Each grooved portion 23C is open inward, e.g., toward the center of the front cover 23 in the left-right direction, and extends in the front-rear direction.

The support member 24 includes a support portion 241 that is a rectangular plate-like member elongated in the front-rear direction, guided portions 242, each disposed at a respective one of left and right end portions of the support portion 241, guide rails 243, each disposed above a respective one of the guided portions 242, and a contact wall 244 protruding upward from a front end of the support portion 241.

Each of the guided portions 242 is shaped like a plate extending along a longitudinal direction of the support portion 241. Each of the guided portions 242 is in engagement with a corresponding one of the grooved portions 23C of the front cover 23. The support member 24 is configured to move relative to the front cover 23 as the guided portions 242 move in the front-rear direction along the grooved portions 23C.

The support portion 241 includes a lock recess 241A disposed at an upper surface thereof, and a pair of slid portions 241B. The lock recess 241A is a portion recessed from an upper surface of the support portion 241. The lock recess 241A includes a plurality of recessed portions disposed at a central portion of the support portion 241 in the left-right direction and aligned in the front-rear direction. Each of the slid portions 241B is disposed at a respective one of left and right sides of the lock recess 241A.

Each guide rail 243 is a plate-like portion protruding outward in the left-right direction from the support portion 241. The guide rail 243 extends from a front end portion of the slid portion 241B to a location proximate to a rear end portion of the slid portion 241B along an extending direction of the slid portions 241B.

The contact wall 244 is a wall configured to contact the regulation guide 100 when the regulation guide 100 is at a foremost position relative to the support member 24. The contact wall 244 is disposed in front of the lock recess 241A and the slid portions 241B. The contact wall 244 extends in the left-right direction from a position corresponding one of the slid portions 241B to a position corresponding to the other one of the slid portions 241B.

When the support member 24 is at a rearmost position relative to the front cover 23, each of the guided portions 242, the lock recess 241A and the guide rails 243 extends from a rear end portion to a front end portion of the front cover 23. Thus, the regulation guide 100 may move from a rear end portion to a front end portion of the front cover 23.

The regulation guide 100 is supported by the support member 24 to slidably move relative to the front cover 23 in the front-rear direction, and is configured to slidably move relative to the front cover 23 in the front-rear direction. As depicted in FIGS. 1 and 3, the regulation guide 100 includes a main body 101 disposed upright on the front cover 23 and having a generally rectangular prism shape, a pair of slide portions 102, each disposed at a lower end portion of a respective one of left and right sides of the main body 101, a first protruding portion 103 and a second protruding portion 104, each protruding from a rear surface of the main body 101 (e.g., a first main body surface 101A described below), and an operative portion 105 (refer to FIG. 2) provided at a front side of the main body 101.

The main body 101 includes the first main body surface 101A as an example of a first surface, a second main body surface 101B, and a pair of third main body surfaces 101C. The first main body surface 101A is a rear surface of the main body 101 and has a generally rectangular shape extending in the top-bottom and left-right directions. The second main body surface 101B extends frontward from an upper end of the first main body surface 101A (e.g. intersects with the first main body surface 101A), and faces upward. One of the third main body surfaces 101C connects to left side ends of the first main body surface 101A and the second main body surface 101B. The other one of the third main body surfaces 101C connects to right side ends of the first main body surface 101A and the second main body surface 101B. In one example, the second main body surface 101B is substantially perpendicular to the first main body surface 101A.

The first main body surface 101A is parallel to the front surface 33A of the end regulating portion 33 when the front cover 23 is open, e.g., when the regulation guide 100 is at an upright position. The first main body surface 101A is configured to regulate a position of a trailing end of a sheet P (e.g., an upstream end of a sheet P in the conveying direction) whose size does not fit within the casing 21. The upper surface 23A of the front cover 23 may be an example of a second supporting portion. When the regulation guide 100 is at the upright position, the first main body surface 101A is substantially perpendicular to the upper surface 23A of the front cover 23.

The first protruding portion 103 is an example of a protruding portion. The first protruding portion 103 protrudes rearward from an upper end of the first main body surface 101A. An upper surface of the first protruding portion 103, e.g., a protruding surface 103A, is flush with the second main body surface 101B. The protruding surface 103A and the second main body surface 101B are an example of a second surface. In one example, the protruding surface 103A is substantially perpendicular to the first main body surface 101A. The protruding surface 103A is continuous with the second main body surface 101B.

The second protruding portion 104 protrudes from a central portion of the first main body surface 101A. The second protruding portion 104 is disposed below the first protruding portion 103 and at a substantially same position as a lower surface of the rear portion B3 of the extension wall 34B of the side guide 34. The first protruding portion 103 protrudes more than the second protruding portion 104.

As depicted in FIG. 2, the operative portion 105 is a portion operated by a user to slidably move the regulation guide 100. The operative portion 105 includes a lock protrusion (reference numeral not designated) disposed at a lower end portion 105B thereof and configured to engage any one of the recessed portions in the lock recess 241A of the support member 24. The operative portion 105 is configured to disengage the lock protrusion from the lock recess 241A by moving an upper end portion 105A rearward to move the lock protrusion. Thus, the regulation guide 100 may be slidably moved relative to the support member 24.

As depicted in FIG. 3, each slide portion 102 has a hook shape and is disposed at a lower end of a respective third main body surface 101C. The slide portion 102 includes a first portion 102A extending outward in the left-right direction from a lower end portion of the third main body surface 101C, a second portion 102B extending downward from an outward end of the first portion 102A in the left-right direction, and a third portion 102C extending inward in the left-right direction from the second portion 102B. Each slide portion 102 engages a corresponding guide rail 243 of the support member 24 such that the guide rail 243 is located between the first portion 102A and the third portion 102C. Accordingly, the regulation guide 100 may move along an extending direction of the guide rails 243. The regulation guide 100 is configured to slidably move relative to the front cover 23 when the slide portions 102 are in engagement with the support member 24. The slide portions 102 are integrally formed with the main body 101. The regulation guide 100 is configured not to pivot relative to the front cover 23.

Accordingly, as depicted in FIG. 1, when the regulation guide 100 is located rearmost on the support member 24 with the front cover 23 being open, the regulation guide 100 is configured to move between the upright position (e.g., a position indicated by a solid line) of when the front cover 23 is open, and a flat position (e.g., a position indicated by a two-dot chain line) of when the front cover 23 is closed, in other words, the flat position where the regulation guide 100 is laid toward the casing 21 relative to the upright position. By closing the front cover 23, the regulation guide 100 is located at the flat position inside the casing 21.

Figure 4:
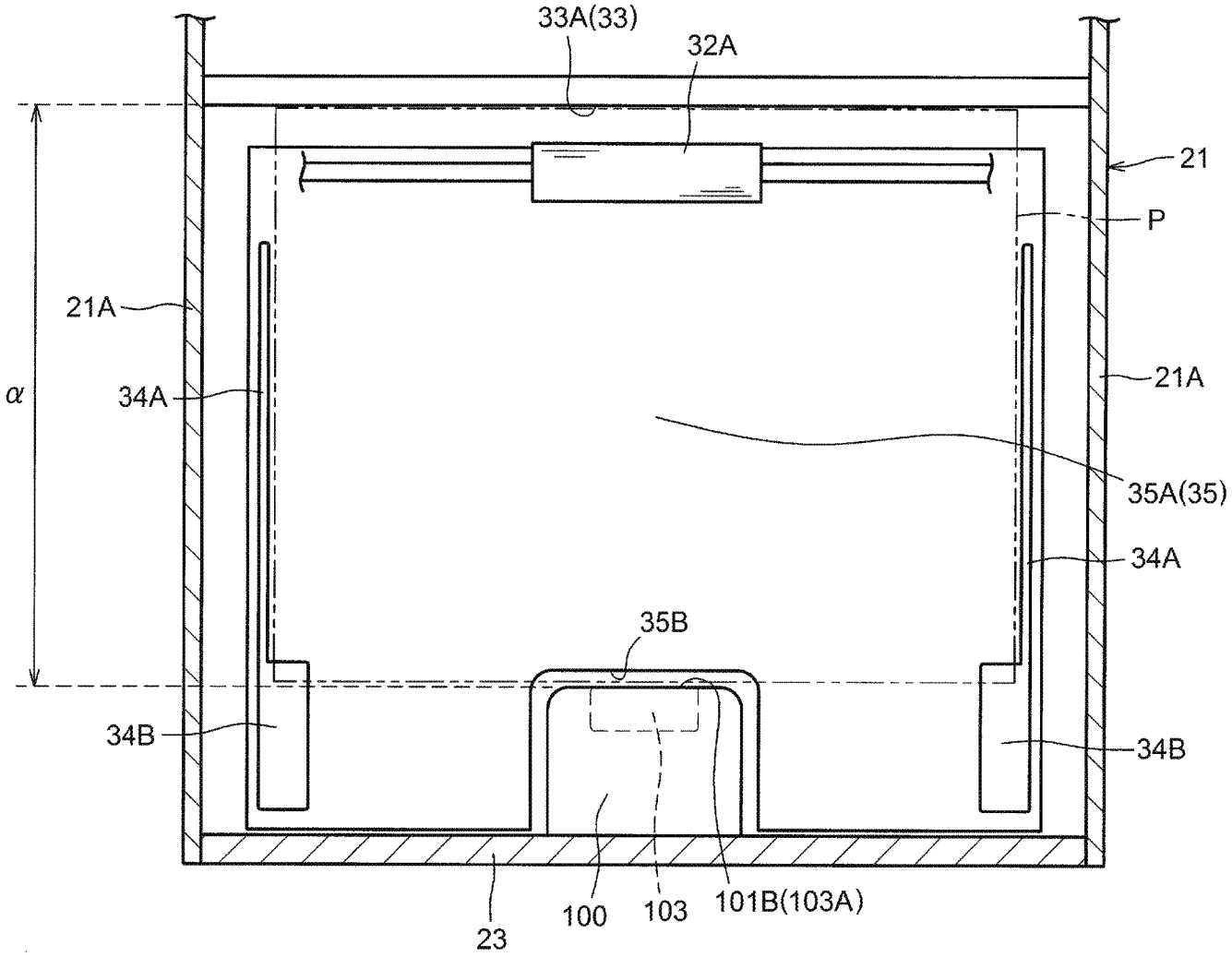
FIG. 4 is a top cross-sectional view of a feed tray when the front cover is closed.

When the regulation guide 100 is at the flat position, the first protruding portion 103 is in the cutout 35B of the lifter plate 35. For example, when the regulation guide 100 is at the flat position, the cutout 35B of the lifter plate 35 accommodates a lower end of the protruding surface 103A (corresponding to a rear end of the protruding surface 103A in FIG. 2 when the regulation guide 100 is at the upright position). In one example, when the regulation guide 100 is at the flat position, the second main body surface 101B and the protruding surface 103A are disposed at positions where the second main body surface 101B and the protruding surface 103A do not interfere with the lifter plate 35 even when the lifter plate 35 pivots, and are parallel to the front surface 33A of the end regulating portion 33. As depicted in FIG. 4, when the regulation guide 100 is at the flat position, the second main body surface 101B and the protruding surface 103A are located further toward the front than a rear end portion of the cutout 35B, when viewed from above. As depicted in FIG. 1, the lower end of the protruding surface 103A when the regulation guide 100 is at the flat position is lower than the supporting surface 35A of the lifter plate 35 when the lifter plate 35 is substantially horizontal. Accordingly, the second main body surface 101B and the protruding surface 103A are configured to regulate a position of an upstream end, in the conveying direction, of a sheet P (whose size fits within the casing 21) when the regulation guide 100 is at the flat position.

As depicted in FIG. 4, when the regulation guide 100 is at the flat position, a distance $\alpha$ from the second main body surface 101B and the protruding surface 103A to the front surface 33A of the end regulating portion 33 may be the same as a length of a shorter side of a sheet P of, for example, A5 size. In this case, the distance $\alpha$ is approximately 148 mm. The laser printer 1 may support sheets P of various sizes, by changing a length, in the front-rear direction, of the regulation guide 100 at the flat position.

As depicted in FIG. 1, an upper end of the second main body surface 101B when the regulation guide 100 is at the flat position is located above a lower surface of the extension wall 34B of the side guide 34. As depicted in FIGS. 1 and 4, when the regulation guide 100 is at the flat position, the second main body surface 101B and the protruding surface 103A are located further to the front than a rear end of the extension wall 34B. A front end portion of the side wall 34A of the side guide 34 is located further to the front than the second main body surface 101B and the protruding surface 103A. Accordingly, a position of a sheet P whose trailing end is regulated by the second main body surface 101B and the protruding surface 103A may be regulated by the side guide 34 with respect to a width direction of the sheet P.

As depicted in FIG. 4, the pickup roller 32A is disposed at a central portion of the casing 21 in the left-right direction. The regulation guide 100 is disposed within a range, in the left-right direction, e.g., a width direction of a sheet P, where the pickup roller 32A is disposed. The lifter plate 35 overlaps with the pickup roller 32A and the regulation guide 100 in the front-rear direction.

Effects of the laser printer 1 as structured above will be described.

First, regulation of a position of a sheet P whose size does not fit within the casing 21 will be described.

When the front cover 23 is open, e.g., when the regulation guide 100 is at the upright position, a sheet P is placed on the supporting surface 35A of the lifter plate 35 and the front cover 23, with a leading end of the sheet P made contact with the front surface 33A of the end regulating portion 33. The regulation guide 100 is moved to a position where the first main body surface 101A of the regulation guide 100 contacts an upstream end of the sheet P in the conveying direction. A position of the regulation guide 100 is thus adjusted, so that a position of the upstream end of the sheet P in the conveying direction may be regulated.

The second protruding portion 104 is located on substantially the same level as the lower surface of the rear portion B3 of the extension wall 34B of the side guide 34, e.g., substantially the same level as the full stack position or the maximum stack height for sheets P. Therefore, positions of upstream ends, in the conveying direction, of all sheets P that the supporting portion 31 is capable of supporting, may be regulated by a portion of the first main body surface 101A below the second protruding portion 104.

Next, regulation of a position of a sheet P whose size fits within the casing 21 will be described.

A sheet P is placed on the supporting surface 35A of the lifter plate 35. The regulation guide 100 at the upright position is set to the most downstream position on the upper surface 23A of the front cover 23 in the conveying direction, and the front cover 23 is closed, e.g., the regulation guide 100 is brought into the flat position. At this time, the regulation guide 100 is located inside the casing 21, such that the second main body surface 101B and the protruding surface 103A contact an upstream end of the sheet P in the conveying direction, to push the sheet P toward the end regulating portion 33. Accordingly, a position of the upstream end of the sheet P in the conveying direction may be regulated.

Thus, by moving the regulation guide 100 from the upright position to the flat position, the second main body surface 101B and the protruding surface 103A may regulate a position of the upstream end, in the conveying direction, of the sheet P whose size is smaller than a size of a sheet P that may be regulated by the first main body surface 101A. Accordingly, convenience for users may be improved when sizes of sheets P are changed.

The lower end of the protruding surface 103A when the regulation guide 100 is at the flat position, is lower than the supporting surface 35A of the lifter plate 35. Therefore, even when a small amount of sheets P (e.g., one sheet) is supported on the supporting surface 35A, a position of an upstream end of the sheet P in the conveying direction may be reliably regulated.

The regulation guide 100 includes the first protruding portion 103. The lower end of the protruding surface 103A when the regulation guide 100 is at the flat position may be located lower than the supporting surface 35A even when the regulation guide 100 has some manufacturing errors. Accordingly, a position of a sheet P may be readily regulated by the second main body surface 101B and the protruding surface 103A.

An upper end of the second main body surface 101B when the regulation guide 100 is at the flat position is located above the lower surface of the extension wall 34B of the side guide 34. Therefore, even when the regulation guide 100 has some manufacturing errors, positions of upstream ends, in the conveying direction, of all sheets P that the supporting portion 31 is capable of supporting, may be reliably regulated by the regulation guide 100.

When the regulation guide 100 is at the flat position, the second main body surface 101B and the protruding surface 103A are located inside the casing 21. Accordingly, a position of an upstream end, in the conveying direction, of a sheet P whose size fits within the casing 21 may be regulated.

When a position of a sheet P is regulated by the second main body surface 101B and the protruding surface 103A, the front cover 23 is closed. Accordingly, a space for the front cover 23 on a front side of the laser printer 1 may be saved.

The lifter plate 35 has the cutout 35B. Therefore, even when the lifter plate 35 pivots, interference between the lifter plate 35 and the regulation guide 100 may be prevented or reduced. The lifter plate 35 may not interfere with the regulation guide 100, so that rattle of the front cover 23 may be prevented or reduced even when the lifter plate 35 pivots.

The second main body surface 101B and the protruding surface 103A are disposed in a range, in the left-right direction, in which the pickup roller 32A is disposed. Accordingly, in a position where a sheet P is conveyed by the pickup roller 32A, a position of an upstream end of the sheet P in the conveying direction may be regulated. Accordingly, conveyance of the sheet P by the pickup roller 32A may be stabilized.

When the regulation guide 100 is at the flat position, the second main body surface 101B and the protruding surface 103A are parallel to the front surface 33A of the end regulating portion 33. Accordingly, a position of a sheet P may be regulated more reliably.

While the disclosure has been described in detail with reference to the specific embodiment, it is to be understood that the disclosure is not limited thereto. Various changes, arrangements and modifications may be applied without departing from the spirit and scope of the disclosure.

In the illustrative embodiment, a position of the regulation guide 100 at the flat position corresponds to a position of the regulating guide 100, at the upright position, located at the most downstream position on the upper surface 23A of the front cover 23 in the conveying direction. However, the disclosure is not limited thereto. For example, a position of the regulation guide 100 at the flat position may not necessarily correspond to the position of the regulating guide 100, at the upright position, located at the most downstream position on the upper surface 23A of the front cover 23 in the conveying direction.

In the illustrative embodiment, the regulation guide 100 includes the first protruding portion 103. However, the disclosure is not limited thereto.

Figure 5A:
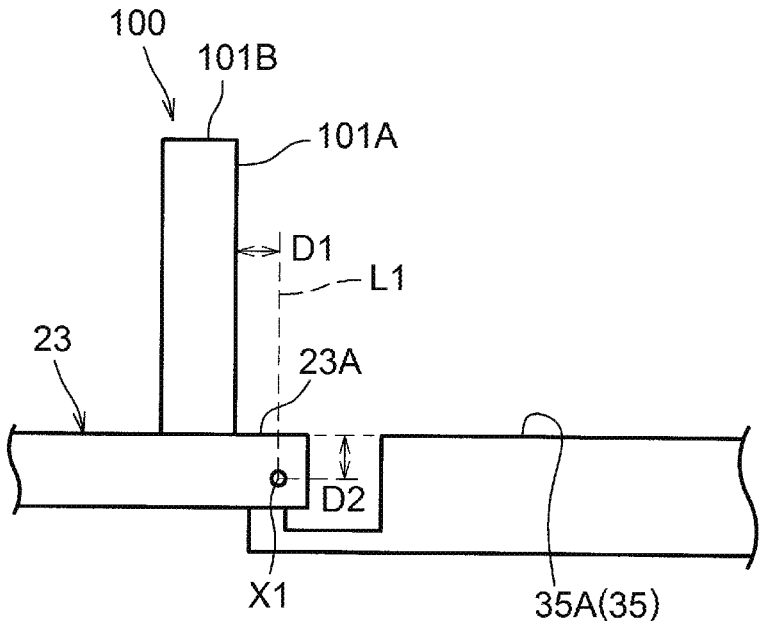
FIG. 5A is a side view of a regulation guide in a first modification according to one or more aspects of the disclosure, wherein the regulation guide is at an upright position.
Figure 5B:
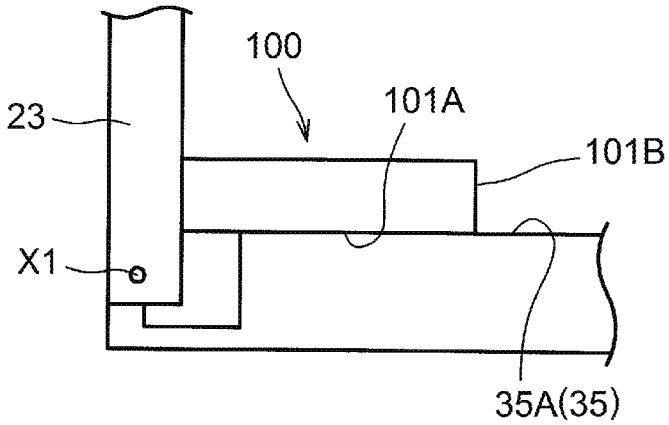
FIG. 5B is a side view of the regulation guide in the first modification, wherein the regulation guide is at a flat position.

In a first modification depicted in FIGS. 5A and 5B, a regulation guide 100 has substantially the same structure as the regulation guide 100 according to the above-described illustrative embodiment, except that the regulation guide 100 in the first modification does not include the first protruding portion 103 and the second protruding portion 104. As depicted in FIGS. 5A and 5B, the upper surface 23A of the front cover 23 is at the same level as a supporting surface 35A of a lifter plate 35. The lifter plate 35 in FIGS. 5A and 5B is configured not to pivot and does not have the cutout 35B.

The front cover 23 is configured to pivot about a first axis X, which is located below the supporting surface 35A and the upper surface 23A of the front cover 23. In this case, the regulation guide 100 is disposed such that a distance D1 between the first main body surface 101A of the regulation guide 100 and a line L1 passing through the first axis X1 and parallel to the top-bottom direction is equal to a distance D2 between the first axis X1 and the upper surface 23A of the front cover 23. Accordingly, when the front cover 23 is closed, the first main body surface 101A contacts the supporting surface 35A. Thus, a lower end of the second main body surface 101B when the regulating guide 100 is at the flat position is at the same level as the supporting surface 35A. Accordingly, positions of upstream ends, in the conveying direction, of an entire stack of sheets P placed on the supporting surface 35A may be regulated by the second main body surface 101B. In this structure, the front cover 23 may have an indication indicating a flat position of the regulating guide 100, so that a user may readily understand the position of the regulation guide 100.

The first axis X1 about which the front cover 23 pivots, may be located at the same level as the supporting surface 35A and the upper surface 23A of the front cover 23. In this case, the distance D2 between the first axis X1 and the upper surface 23A of the front cover 23 is zero (0), so that the first main body surface 101A of the regulation guide 100 may be positioned such that it is flush with the line L1 passing through the first axis X1 and parallel to the top-bottom direction.

In the illustrative embodiment, the regulation guide 100 is configured not to pivot relative to the front cover 23. However, the disclosure is not limited thereto.

Figure 6:
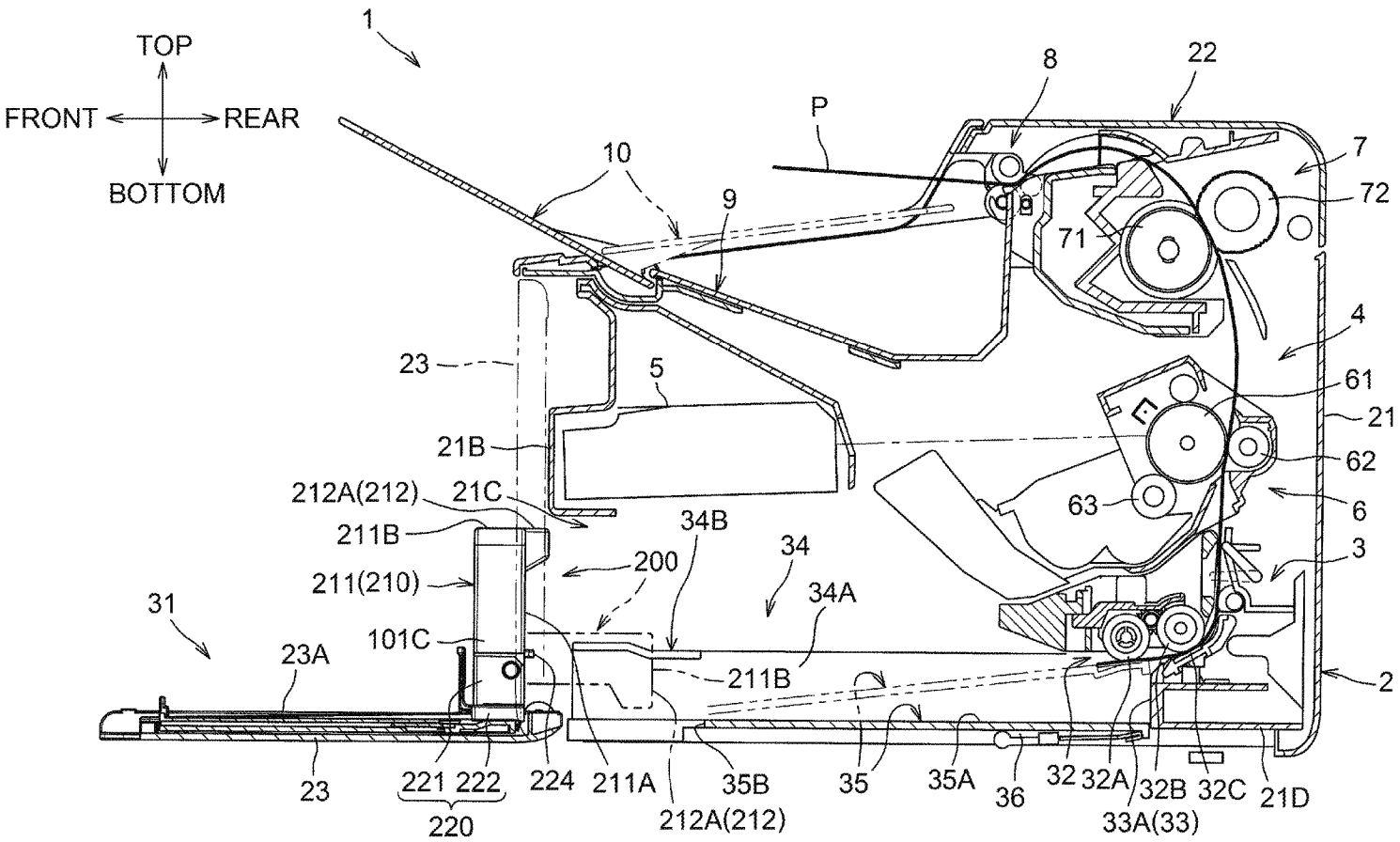
FIG. 6 depicts general structures of a laser printer in a second modification according to one or more aspects of the disclosure.

In a second modification depicted in FIG. 6, a regulation guide 200 as an example of a first regulation member is configured to pivot relative to the front cover 23.

Figure 7:
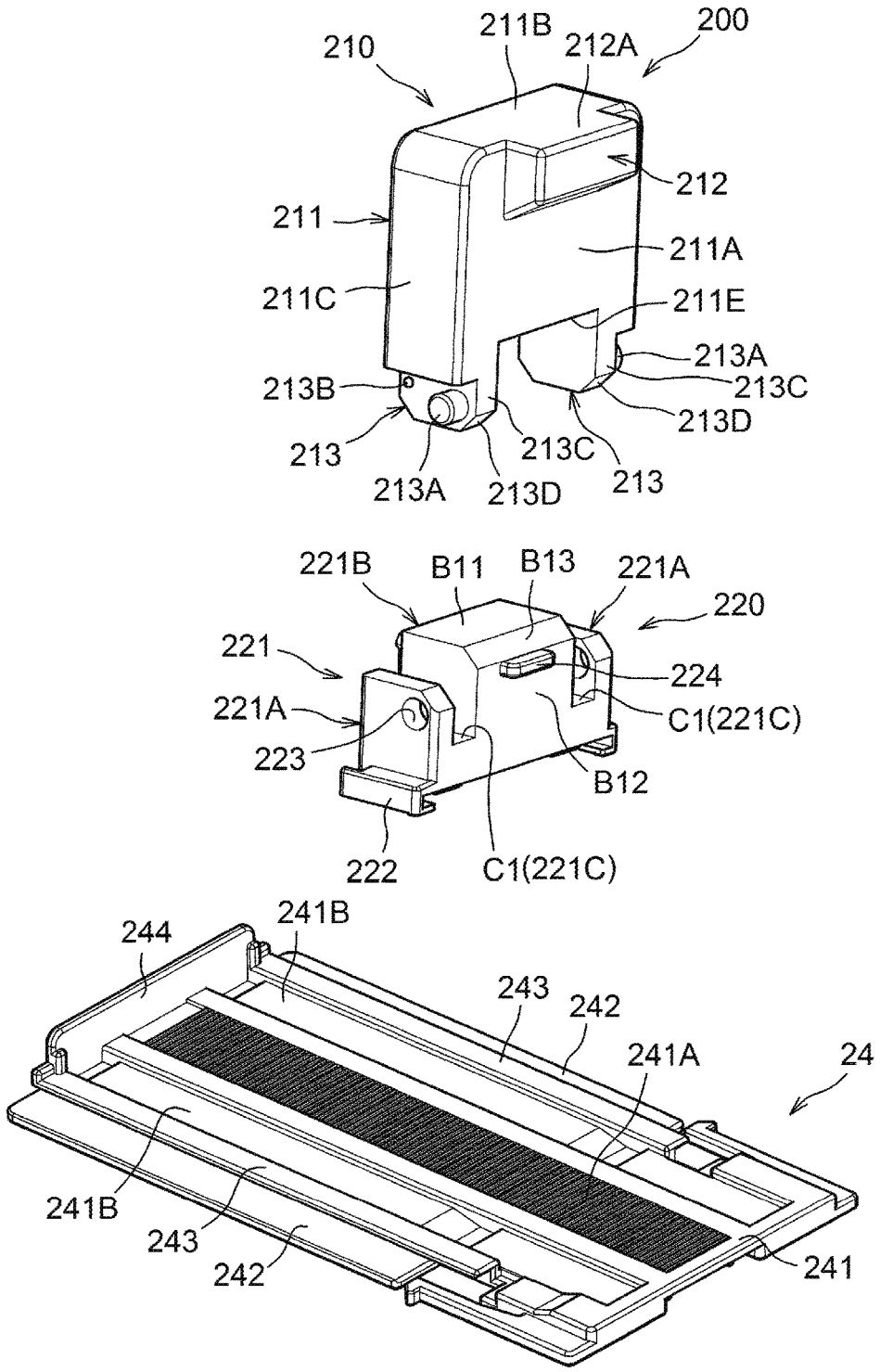
FIG. 7 is an exploded perspective view of a regulation guide in the second modification according to one or more aspects of the disclosure, and the support member.

The regulation guide 200 includes a movable member 220, and a regulation member 210 configured to pivot relative to the movable member 220. As depicted in FIG. 7, the regulation member 210 includes a main body 211, a first protruding portion 212, and a pair of leg portions 213, each extending from a respective one of left and right lower end portions of the main body 211.

The main body 211 includes a first main body surface 211A, a second main body surface 211B, and a third main body surface 211C that are the same or similar to the first main body surface 101A, the second main body surface 101B and the third main body surface 101C of the main body 101 according to the illustrative embodiment, respectively. The first protruding portion 212 includes a protruding surface 212A that is the same or similar to the protruding surface 103A of the first protruding portion 103 in the illustrative embodiment.

A side surface of each leg portion 213 is located further to the center of the regulation member 210 in the left-right direction than a corresponding one of the third main body surfaces 211C of the main body 211. The leg portion 213 includes a rotation shaft 213A and a protrusion 213B both protruding outward in the left-right direction from the side surface of the leg portion 213. The rotation shaft 213A is located at a rear portion of the side surface of the leg portion 213. The protrusion 213B is located at a front portion of the side surface of the leg portion 213. Each leg portion 213 includes a first inclined surface 213D that extends downward and frontward from a lower end of a corresponding rear surface 213C and connects to a rear end of a lower surface of a corresponding leg portion 213.

The movable member 220 is a member that pivotally supports the regulation member 210. The movable member 220 includes a support portion 221 that supports the regulation member 210, and a pair of the slide portions 222 disposed at lower end portions of the support portion 221. Each slide portion 222 has the same or similar structure as the slide portion 102 in the illustrative embodiment.

The support portion 221 has the same dimension as the regulation member 210 in the left-right direction and in the front-rear direction. The support portion 221 includes a pair of first walls 221A, each disposed at an outward position relative to a corresponding one of the leg portions 213 in the left-right direction, a second wall 221B disposed between the leg portions 213, and third walls 221C, each disposed below a corresponding one of the leg portions 213 and connecting lower ends of the first walls 221A and the second wall 221B.

Each first wall 221A has a hole 223 formed at a position corresponding to a corresponding rotation shaft 213A. The hole 223 passes through the first wall 221A in the left-right direction. The regulation member 210 is configured to pivot relative to the movable member 220 when the rotation shaft 213A is in engagement with the hole 223.

The first wall 221A includes an engagement portion (not depicted) formed at a position corresponding to the protrusion 213B. The engagement portion engages the protrusion 213B, so that pivotal movement of the regulation member 210 by its own weight may be prevented.

The protrusion 213B lightly engages the movable member 220. As a user applies force to the regulation member 210 to pivot the regulation member 210 rearward, the protrusion 213B disengages from the movable member 220 readily. When the regulation guide 200 is brought into the flat position by pivoting the front cover 23, the protrusion 213B is in engagement with the movable member 220 with such a force that the regulation member 210 does not pivot relative to the movable member 220. Alternatively, the protrusion 213B may not necessarily be provided. In this case, the regulation guide 200 may be configured such that, when the regulation guide 200 is located at the flat position, the first protruding portion 212 may pass through the cutout 35B of the lifter plate 35 to contact, for example, an installation surface of the main unit 2.

The second wall 221B includes an upper surface B11, a rear surface B12, and a second inclined surface B13. The upper surface B11 contacts a lower end surface 211E of the main body 211 between the leg portions 213. The second inclined surface B13 extends downward and rearward from a rear end of the upper surface B11, and connects to an upper end of the rear surface B12.

The second wall 221B includes a second protruding portion 224 protruding rearward from the rear surface B12. The second protruding portion 224 is disposed above the rotation shaft 213A and at substantially the same level as the lower surface of the extension wall 34B of the side guide 34. For example, a position of the lower surface of the second protruding portion 224 corresponds to the full stack position or the maximum stack height for sheets P.

Each third wall 221C includes an upper surface C1 that contacts a lower surface of a corresponding leg portion 213. The upper surface C1 of the third wall 221C is configured to contact the first inclined surface 213D and the rear surface 213C of the leg portion 213 when the regulation member 210 pivots. In one example, as the regulation member 210 starts to pivot, the first inclined surface 213D contacts the upper surface C1 of the third wall 221C. As the regulation member 210 further pivots, the rear surface 213C contacts the upper surface C1 of the third wall 221C. Thus, further pivotal movement of the regulation member 210 from the flat position may be prevented.

With the second inclined surface B13, the main body 211 pivots along the second inclined surface B13 when the regulation member 210 pivots. Accordingly, when the regulation member 210 pivots, interference between the main body 211 and the second wall 221B may be prevented or reduced by the second inclined surface B13.

Operations of the regulation guide 200 as structured above will be described. The regulation guide 200 pivots rearward from the upright position about the rotation shaft 213A of the leg portion 213. At this time, the leg portion 213 may pivot smoothly by virtue of the first inclined surface 213D, without interfering with the third wall 221C, and the main body 211 may pivot smoothly without interfering with the second inclined surface B13.

Then, the rear surface 213C of the leg portion 213 contacts the upper surface C1 of the third wall 221C, and the regulation guide 200 moves to the flat position. Thus, the regulation guide 200 moves from the upright position to the flat position. A position of an upstream end of a sheet P in the conveying direction may be regulated by just moving the regulation guide 200 from the upright position to the flat position. In this structure, the second main body surface 211B and the protruding surface 212A when the regulation guide 200 is at the flat position may not necessarily be located inside the casing 21.

In the second modification depicted in FIG. 7, the regulation guide 200 includes the first protruding portion 212. However, the disclosure is not limited thereto.

Figure 8A:
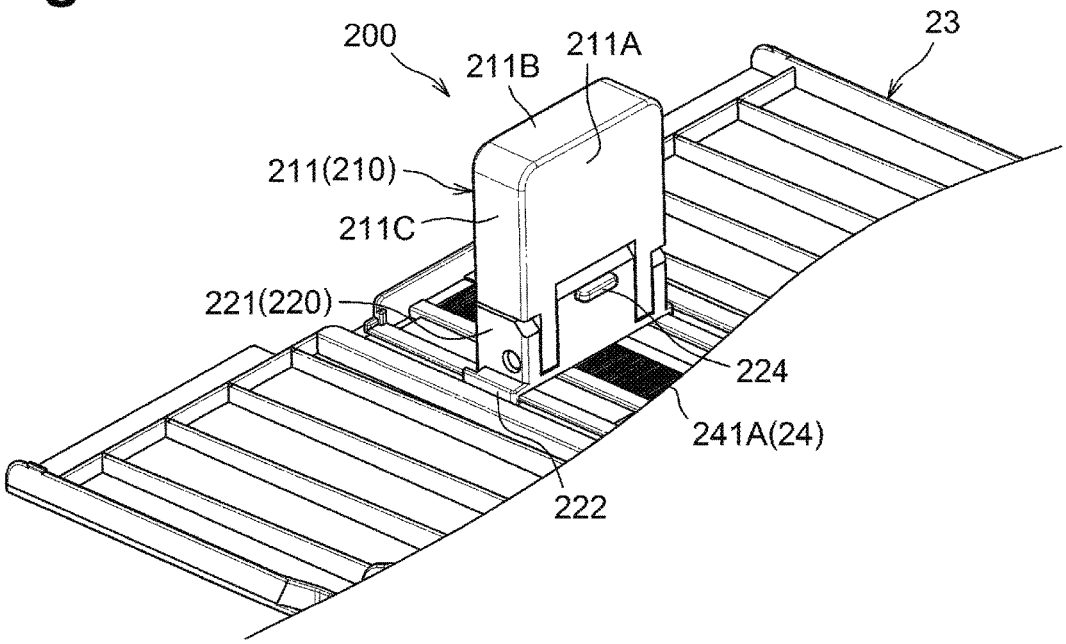
FIG. 8A is a perspective view of a regulation guide in a third modification according to one or more aspects of the disclosure, wherein the regulation guide is at the upright position.

In a third modification depicted in FIG. 8A, a regulation guide 200 does not include the first protruding portion 212.

Figure 8B:
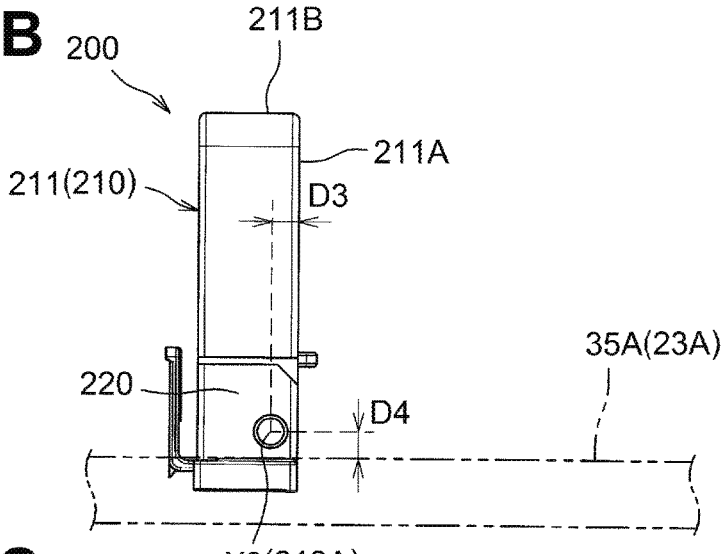
FIG. 8B is a side view of the regulation guide in the third modification, wherein the regulation guide is at the upright position.
Figure 8C:
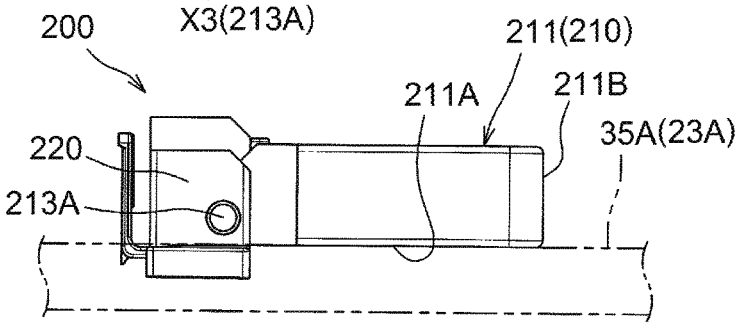
FIG. 8C is a side view of the regulation guide in the third modification wherein the regulation guide is at the flat position.

The regulation guide 200 of the third modification has generally the same shape as the regulation guide 200 of the second modification depicted in FIG. 7, except that the regulation guide 200 in FIG. 8A does not include a first protruding portion. As depicted in FIG. 8B, a distance D3 from a rotation axis X3 of the rotation shaft 213A to the first main body surface 211A of the main body 211 is equal to a distance D4 from the supporting surface 35A and the upper surface 23A of the front cover 23 to the rotation axis X3. In this structure, as depicted in FIG. 8C, when the regulation guide 200 is moved from the upright position to the flat position, the first main body surface 211A contacts the supporting surface 35A. Accordingly, a lower end of the second main body surface 211B when the regulating guide 200 is at the flat position is at the same level as the supporting surface 35A. Therefore, positions of upstream ends, in the conveying direction, of an entire stack of sheets P on the supporting surface 35A may be regulated by the second main body surface 211B.

In the illustrative embodiment, the lifter plate 35 is pivotally supported about the rotation shafts 35C disposed at front end portions of the casing 21. However, the disclosure is not limited thereto.

Figure 9A:
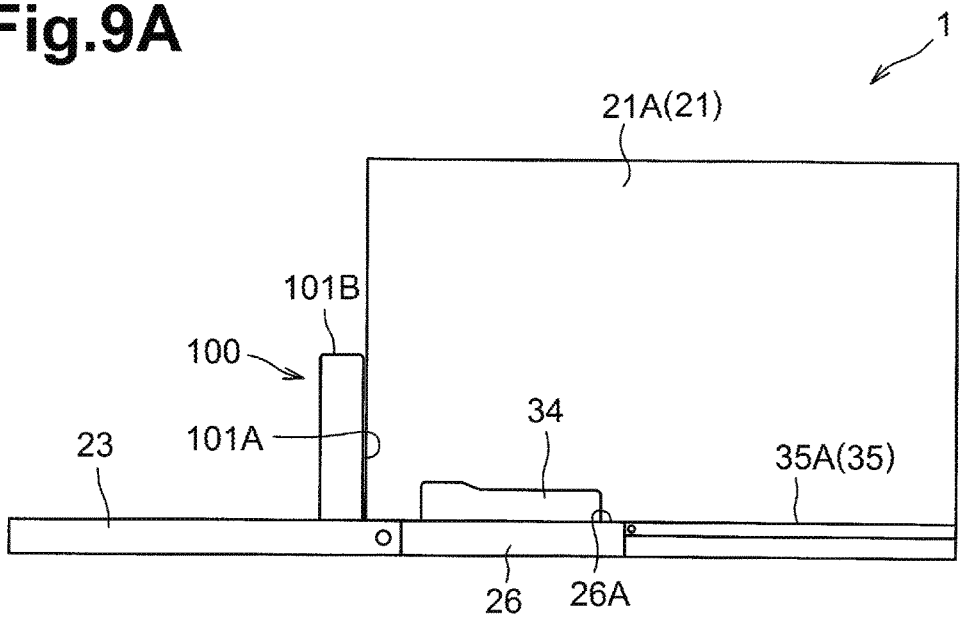
FIG. 9A depicts a laser printer in a fourth modification according to one or more aspects of the disclosure, wherein the front cover is open.
Figure 9B:
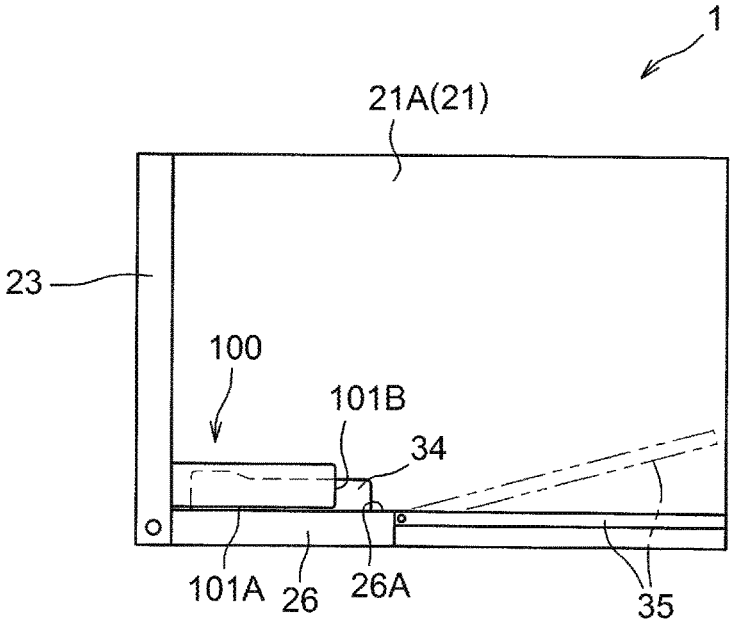
FIG. 9B depicts the laser printer in the fifth modification, wherein the front cover is closed.

In a fourth modification depicted in FIGS. 9A and 9B, a lifter plate 35 may be pivotally supported about a portion near a central portion of a casing 21 in the front-rear direction.

A regulation guide 100 of the fourth modification has structures similar to the regulation guide 100 of the first modification depicted in FIGS. 5A and 5B. A lower frame 26 connecting lower ends of the side frames 21A is disposed in front of the lifter plate 35. The lower frame 26 includes an upper surface 26A disposed at the same level as a supporting surface 35A of the lifter plate 35. The lower frame 26 includes a pair of the side guides 34. With this structure, the lower end of the second main body surface 101B of the regulation guide 100 when the regulation guide 100 is moved to the flat position from the upright position, is at the same level as the upper surface 26A and the supporting surface 35A. Therefore, a position of an upstream end of a sheet P in the conveying direction may be regulated by the second main body surface 101B. In a structure in which the regulation guide 100 includes a first protruding portion, an accommodating portion may be provided at a portion of the lower frame 26 corresponding to the first protruding portion.

In the illustrative embodiment, sheets P are fed from the supporting portion 31 using the lifter plate 35. However, the disclosure is not limited thereto. For example, sheets P may be fed from the supporting portion 31 by using a so-called bank separation method in which the sheets P are separated one by one by bringing the sheets P in contact with a slope. In this structure, a regulation guide may be inclined relative to the top-bottom direction and in a rearward direction from a bottom to a top thereof.

In the illustrative embodiment, an upper end of the second main body surface 101B when the regulation guide 100 is at the flat position is located above the extension walls 34B, each disposed at the same level, of the side guides 34. However, the disclosure is not limited thereto. For example, the upper end of the second main body surface 101B of the regulation guide 100 located at the flat position may be located at the same level as the lower surface of the extension wall 34B.

In the illustrative embodiment, a lower end of the protruding surface 103A when the regulation guide 100 is at the flat position, is located below the supporting surface 35A of the lifter plate 35. However, the disclosure is not limited thereto. For example, the lower end of the protruding surface 103A may be located at the same level as the supporting surface 35A.

In the illustrative embodiment, the lifter plate 35 has the cutout 35B. However, the disclosure is not limited thereto. The lifter plate 35 may include a recess recessed downward into the lifter plate 35. In this case, the recess may have such a depth that a bottom surface of the recess does not interfere with the first regulation guide at the flat position when the lifter plate 35 is moved.

In the illustrative embodiment, a side guide 34 includes an extension wall 34B. However, the disclosure is not limited thereto. The extension wall 34B may be omitted. In this case, a position of an upper end of a regulation guide at the flat position or an upper end of a side guide may be used as a reference for the full stack position or the maximum stack height for sheets P.

In the illustrative embodiment, the regulation guide 100 is entirely disposed within a range, in the left-right direction, where the pickup roller 32A is disposed. However, the disclosure is not limited thereto. For example, a portion of a regulation guide may be disposed in a range, in the left-right direction, where the pickup roller 32A is disposed.

In the illustrative embodiment, the regulation guide 100 is configured to move on the support member 24. However, the disclosure is not limited thereto. For example, the regulation guide 100 may be configured to slidably move directly on the front cover 23.

In the illustrative embodiment, the regulation guide 100 includes the second protruding portion 104. However, the disclosure is not limited thereto. The regulation guide 100 may not necessarily include the second protruding portion 104.

In the illustrative embodiment, the disclosure is applied to the laser printer 1. However, the disclosure is not limited thereto. For example, the disclosure may be applied to other image forming apparatuses, e.g., a copier and a multi-functional apparatus.

What is claimed is:

1. An image forming apparatus, comprising:

a casing having an opening;

a supporting portion configured to support a sheet inserted through the opening, the supporting portion including a support surface;

a feed roller configured to feed the sheet supported on the supporting portion; and a first regulation member configured to move between an upright position and a flat position where the first regulation member is laid relative to the upright position, the first regulation member including:

a first surface facing the feed roller when the first regulation member is at the upright position; and a second surface intersecting with the first surface, the second surface facing upward when the first regulation member is at the upright position, the second surface facing the feed roller when the first regulation member is at the flat position such that the second surface regulates a position of an upstream end, in a sheet conveying direction, of the sheet supported on the supporting portion of the casing, wherein a lower end of the second surface of the first regulation member located at the flat position is below the supporting surface of the supporting portion; and a pair of second regulation guides, each configured to regulate a side end of a sheet supported on the supporting surface and including an overload preventing portion configured to prevent the supporting surface from being overloaded with sheets, wherein an upper end of the second surface of the first regulation member located at the flat position is above the overload preventing portion.

2. The image forming apparatus according to claim 1, further comprising a cover configured to open and close the opening of the casing, wherein the first regulation member is supported by the cover and configured to, when the opening is open, slide on the cover along the sheet conveying direction.

3. The image forming apparatus according to claim 1, wherein the first surface of the first regulation member located at the upright position is configured to regulate a position of an upstream end, in the sheet conveying direction, of a different sheet supported on the supporting portion, the different sheet being different in size from the sheet restricted by the second surface of the first regulation member located at the flat position.

4. The image forming apparatus according to claim 1, wherein the first regulation member includes a protruding portion protruding from the first surface and constituting a portion of the second surface.

5. The image forming apparatus according to claim 1, wherein the supporting portion includes a first supporting portion and a second supporting portion, wherein the first regulation member is supported by the second supporting portion and configured to slide on the second supporting portion along the sheet conveying direction, and wherein, when the first regulation member is at the flat position, the second surface is located on the first supporting portion.

6. The image forming apparatus according to claim 1, further comprising a cover configured to open and close the opening of the casing, wherein the first regulation member is supported by the cover and located at the flat position when the opening of the casing is closed by the cover.

7. The image forming apparatus according to claim 6, wherein the first regulation member is not pivotable relative to the cover.

8. The image forming apparatus according to claim 1, wherein the first regulation member is pivotable relative to the cover.

9. The image forming apparatus according to claim 8, wherein the supporting portion includes a first supporting portion and a second supporting portion, wherein the first regulation member is supported by the second supporting portion and configured to slide on the second supporting portion along the sheet conveying direction, and wherein the first supporting portion includes a supporting surface and a lower end of the second surface of the first regulation member located at the flat position is below the supporting surface of the second supporting portion.

10. The image forming apparatus according to claim 1, wherein the supporting portion includes a first supporting portion, which disposed in the casing, and a second supporting portion, which is disposed outside of the casing and configured to pivot to a position substantially orthogonal to the first supporting portion, and wherein, when the second supporting portion is located substantially orthogonal to the first supporting portion, the first regulation member is located at the flat position.

11. The image forming apparatus according to claim 10, further comprising a lifter plate movable relative to the casing, the lifter plate constituting at least a portion of the first supporting portion.

12. The image forming apparatus according to claim 11, wherein the lifter plate includes an accommodating portion which accommodates a lower end of the second surface of the first regulation member located at the flat position.

13. The image forming apparatus according to claim 1, wherein the first regulation member is disposed within a range, in a sheet width direction, where the feed roller is disposed.

14. The image forming apparatus according to claim 1, further comprising a cover configured to open and close the opening of the casing, wherein, when the opening of the casing is closed, the second surface of the first regulation member regulates the position of the upstream end of the sheet supported on the supporting portion, and wherein, when the opening of the casing is open, the second surface of the first regulation member does not regulate the position of the upstream end of the sheet supported on the supporting portion.

* * * * *